US006311416B1

(12) United States Patent
Cohen

(10) Patent No.: US 6,311,416 B1
(45) **Date of Patent: *Nov. 6, 2001**

(54) THERAPEUTIC SHOE

(75) Inventor: Shimon Cohen, Kfar Saba (IL)

(73) Assignee: Shimi-Shoe Walking Technologies Ltd., Tel Aviv (IL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/449,748

(22) Filed: Nov. 26, 1999

(51) Int. Cl.[7] ..... A43B 23/00

(52) U.S. Cl. ..... 36/136; 36/140; 36/15; 36/115

(58) Field of Search ..... 36/140, 141, 132, 36/136, 115, 116, 117.1, 117.3, 117.4, 15

(56) References Cited

U.S. PATENT DOCUMENTS

| | | | | |
|---|---|---|---|---|
| 1,189,329 | * | 7/1916 | Winagle | 36/136 |
| 1,558,192 | | 10/1925 | Lindgren . | |
| 2,095,942 | * | 10/1937 | Wetterstrand | 36/136 |
| 2,510,654 | | 6/1950 | Pepin . | |
| 2,734,286 | | 2/1956 | Anson . | |
| 3,019,534 | * | 2/1962 | Kauffman et al. | 36/15 |
| 3,677,567 | * | 7/1972 | Salomon | 36/132 |
| 4,291,473 | * | 9/1981 | Sartor | 36/132 |
| 4,441,264 | | 4/1984 | Hantz-Guibas et al. . | |
| 4,459,764 | | 7/1984 | Beck . | |
| 4,598,484 | | 7/1986 | Ma . | |
| 4,662,082 | | 5/1987 | Shabazz . | |
| 4,738,262 | * | 4/1988 | Zebrack | 36/132 |
| 4,774,775 | * | 10/1988 | Pruitt | 36/132 |
| 4,776,108 | * | 10/1988 | Bayless | 36/132 |
| 4,821,432 | * | 4/1989 | Reiber | 36/132 |
| 5,005,301 | * | 4/1991 | Mabboux | 36/117.1 |
| 5,029,575 | | 7/1991 | Zhivotchenko et al. . | |
| 5,070,867 | * | 12/1991 | March | 36/136 |
| 5,170,574 | * | 12/1992 | Weisbrich | 36/132 |
| 5,176,624 | * | 1/1993 | Kuehnreich | 36/15 |

* cited by examiner

*Primary Examiner*—Paul T. Sewell
*Assistant Examiner*—Jila Mohandesi
(74) *Attorney, Agent, or Firm*—Mark M. Friedman

(57) ABSTRACT

A therapeutic shoe for shifting the weight exerted on the foot of a wearer in a frontward or rearward direction as required has a sole and an upper portion configured to retain the foot of the user in contact with the sole. A recessed track, formed in the lower surface of the sole, extends parallel to the length of the sole and along a major portion of its length. At least one support block is provided for attachment to the lower surface of the sole at any of a plurality of positions along the entirety of the recessed track. Also provided is a heel protection configuration.

7 Claims, 5 Drawing Sheets

THERAPEUTIC SHOE

FIELD AND BACKGROUND OF THE INVENTION

The present invention relates to therapeutic shoes and, in particular, it concerns shoes suited for mass production which allow selective and personalized weight shifting or pressure relief to critical regions of the foot.

It is known that various patients require selective relief of pressure on parts of their feet, either as part of the treatment for an existing medical condition or to prevent certain conditions developing. This is particularly true for patients prone to peripheral circulatory problems such as is a common consequence of diabetes. Pressure control is also often required or desirable during recovery post-operatively and due to various other sources of foot trauma.

Relief of pressure could be achieved by modifying a shoe so that weight is transferred to other parts of the foot. However, since the region in which pressure relief is required varies from patient to patient, this approach would require manual modification of shoes on an individual basis. Such an approach would be very labor intensive and costly. The shoe, once modified, would also becomes useless when the pressure relief therapy was no longer required.

A related problem, again particularly in patients prone to peripheral circulatory problems, results from localized pressure which may be applied for extended periods on the heel of the foot while the patient is in bed.

There is therefore a need for a therapeutic shoe suitable for mass production which would allow readily adjustable weight shifting, which would offer protection to the heel from pressure while sleeping, and which would allow the shoe to be used as a conventional shoe at other times.

SUMMARY OF THE INVENTION

The present invention is a therapeutic shoe.

According to the teachings of the present invention there is provided, a therapeutic shoe configured to facilitate shifting the weight exerted on the foot of a wearer in a frontward or rearward direction as required, the shoe comprising: (a) a sole providing an upper surface for supporting the foot of the wearer and a lower surface, the sole having a long dimension termed length; (b) an upper portion associated with the sole and configured to retain the foot of the user in contact with the sole; (c) a recessed track formed in the lower surface of the sole and extending substantially parallel to the length along a major portion of the length; and (d) a support block having an engagement projection configured for engaging the recessed track and a load-supporting body configured to extend in a direction substantially perpendicular to the length, the support block being configured so as to be attachable to the lower surface at any one of a plurality of positions along substantially the entirety of the recessed track.

According to a further feature of the present invention, the recessed track includes at least one undercut ridge, the recessed track being open at at least one end, and wherein the engagement projection is configured to engage the undercut ridge.

According to a further feature of the present invention, the recessed track is a substantially T-shaped track open at at least one end, and wherein the engagement projection is formed as a complementary T-shaped projection.

According to a further feature of the present invention, wherein the load-supporting body is formed with a rounded lower profile as viewed along its direction of extension.

According to a further feature of the present invention, there are also provided at least two threaded fastening elements for attaching the support block to the lower surface.

According to a further feature of the present invention, there is also provided an additional support block having an engagement projection configured for engaging the recessed track and a load-supporting body configured to extend in a direction substantially perpendicular to the length, the support block and the additional support block being attachable at different positions along the recessed track.

According to a further feature, the present invention is additionally configured to avoid pressure on the heel of a foot while a wearer is lying in a supine position on an underlying surface, the upper portion being configured to retain the foot in a position such that the heel of the foot lies adjacent to the rear edge of the sole, the upper portion having at least one opening adjacent to the rear edge so as to avoid contact with at least a part of the heel of the foot, the shoe further comprising a pressure release bracket configured to releasably engage the sole so that the sole is supported by the pressure release bracket with the rear edge raised above the underlying surface.

There is also provided according to the teachings of the present invention, a therapeutic shoe configured to avoid pressure on the heel of a foot while a wearer is lying in a supine position on an underlying surface, the shoe comprising: (a) a sole providing an upper surface for supporting the foot of the wearer, the sole having a rear edge; (b) an upper portion associated with the sole and configured to retain the foot of the user in contact with the sole in a position such that the heel of the foot lies adjacent to the rear edge, the upper portion having at least one opening adjacent to the rear edge so as to avoid contact with at least a part of the heel of the foot; and (c) a pressure release bracket configured to releasably engage the sole so that the sole is supported by the pressure release bracket with the rear edge raised above the underlying surface.

According to a further feature of the present invention, the sole features a slot adjacent to the rear edge, and wherein the pressure release bracket is implemented as a substantially flat sheet configured to engage the slot.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a therapeutic shoe.

The principles and operation of shoes according to the present invention may be better understood with reference to the drawings and the accompanying description.

Before turning to details of the present invention, it should be appreciated that the present invention provides two sets of features, each of which may be used alone, or which may be combined to provide a particularly useful and versatile product. The first set of features, relating to an adjustable weight shifting configuration, will be described with particular reference to FIGS. 1–3. The second set of features, relating to relief of pressure on the heel while sleeping, will then be described with reference to FIGS. 4 and 5.

Figure 1:
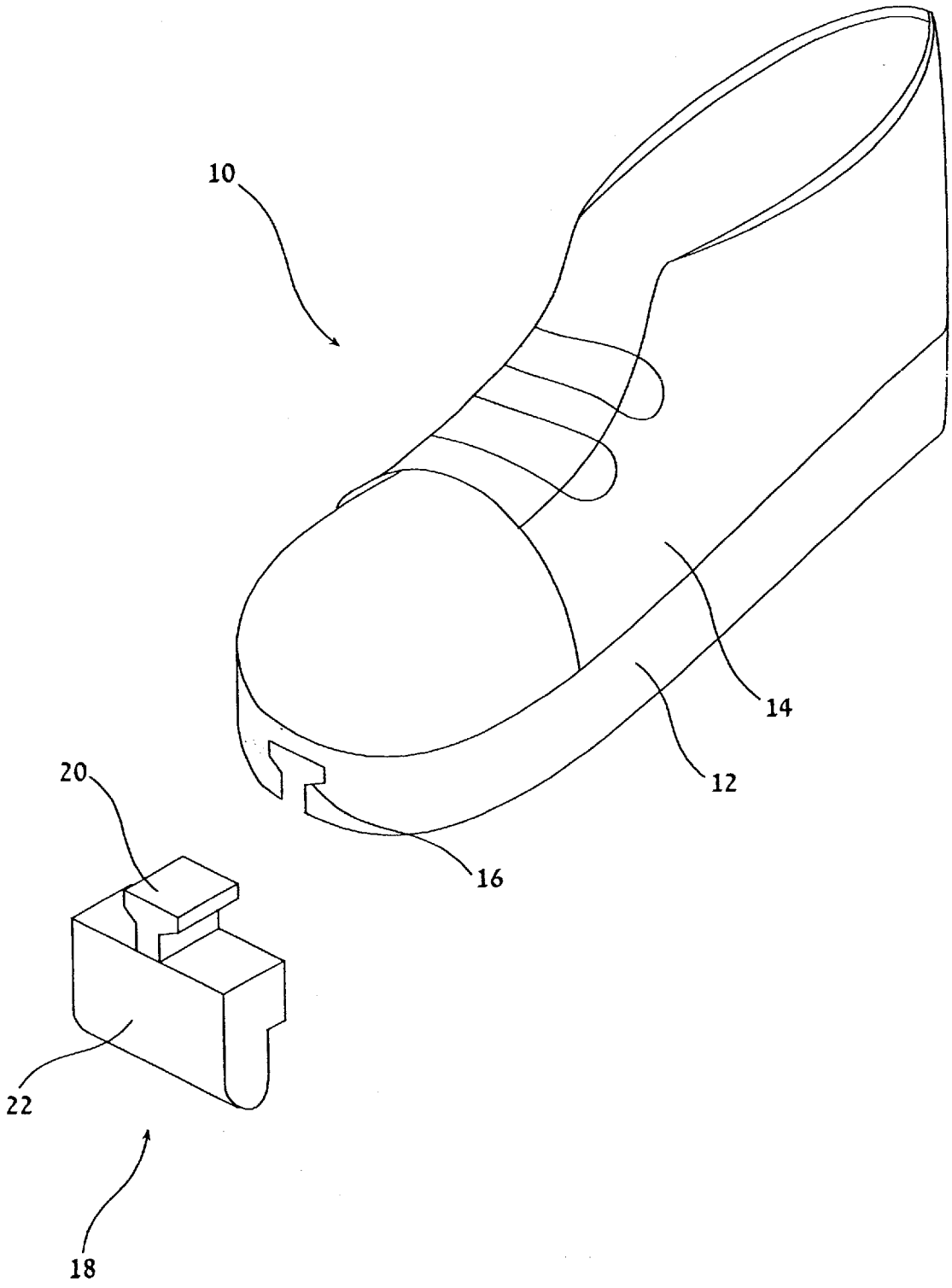
FIG. 1 is a schematic front isometric view of a first embodiment of a therapeutic shoe, constructed and operative according to the teachings of the present invention.
Figure 2:
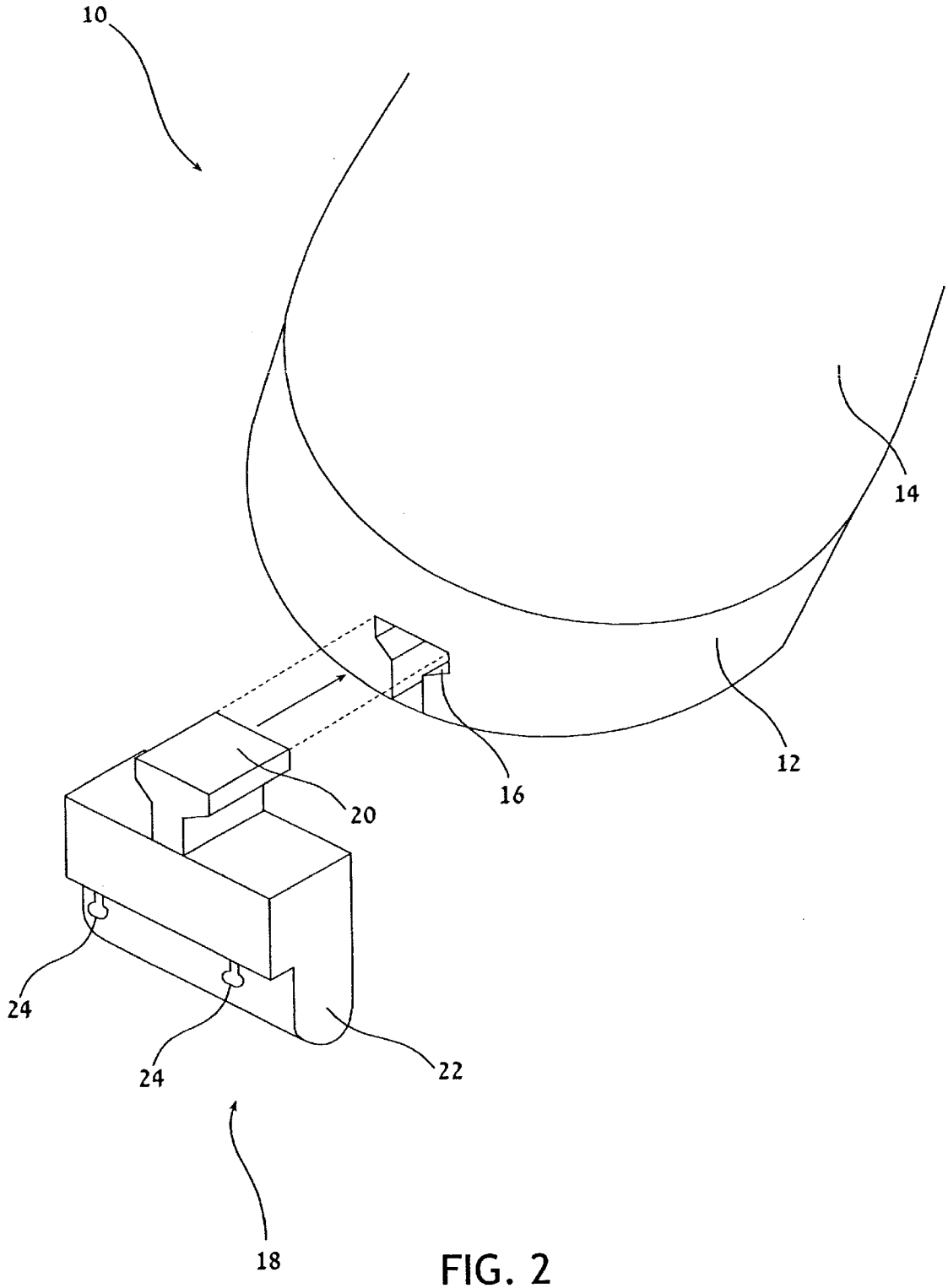
FIG. 2 is a schematic partial rear isometric view of the therapeutic shoe of FIG. 1.

Referring now to the drawings, FIGS. 1–3 show a first embodiment of a therapeutic shoe, generally designated 10, configured to facilitate shifting the weight exerted on the foot of a wearer (not shown) in a frontward or rearward direction as required. Generally speaking, shoe 10 includes a sole 12 providing an upper surface for supporting the foot of the wearer, and an upper portion 14 associated with sole 12 and configured to retain the foot of the user in contact with the sole. A recessed track 16 is formed in the lower surface of sole 12 and extends substantially parallel to a dimension of the sole termed "length" along a major portion of the length. A support block 18 has an engagement projection 20 configured for engaging recessed track 16 and a load-supporting body 22 configured to extend in a direction substantially perpendicular to the length. Support block 18 is configured so as to be attachable to the lower surface of sole 12 at any one of a plurality of positions along substantially the entirety of recessed track 16.

It will be readily apparent that therapeutic shoe 10, formed from standard components suitable for mass production techniques, readily allows positioning of one or more support block 18 to offer personalized weight shifting and pressure release. Furthermore, support block 18 may subsequently be adjusted and, after the completion of the therapy, may be removed altogether to allow shoe 10 to be used as a normal shoe.

Turning now to the features of therapeutic shoe 10 in more detail, recessed track 16 is preferably open at at least one end of sole 12 and, most preferably, extends the full length of sole 12 so as to be open at both ends (see FIGS. 1 and 2). Optionally, in the case that both ends are open, track 16 may be interrupted at some point along its length, such as to provide a region of reinforcement for sole 12. Track 16 preferably includes at least one undercut ridge, most preferably in the form of a substantially T-shaped track, as shown.

Engagement projection 20 is preferably configured to engage the undercut ridge of track 16. In the case of a T-shaped slot, engagement projection 20 is preferably formed as a complementary T-shaped projection. This serves to retain support block 18 against sole 12, and to define both the lateral position and the orientation of support block 18 relative to sole 12. There remains only one degree of freedom for adjustment of the support block, namely, in the frontward-rearward directions relative to sole 12.

The required position of each support block 18 along track 16 is preferably fixed by tightening of one or more fastening element which extend through block 18 into sole 12. Preferably, these are implemented as at least two threaded fastening elements 24, typically in the form of self-drilling screws, which are inserted through a fastening flange of the support block (see FIG. 2) and are configured to become lodged in sole 12 when tightened.

Load-supporting body 22 is typically has a height (i.e., the extent to which sole is raised locally above the underlying surface) of up to about 2 cm. Depending upon the intended therapy, heights of either about 2 cm or about 1 cm are thought to be preferred. In order to make walking as comfortable as possible, load-supporting body 22 preferably has a rounded lower profile as viewed along its direction of extension, i.e., from the side as seen in FIGS. 3A–3D.

Figure 3A:
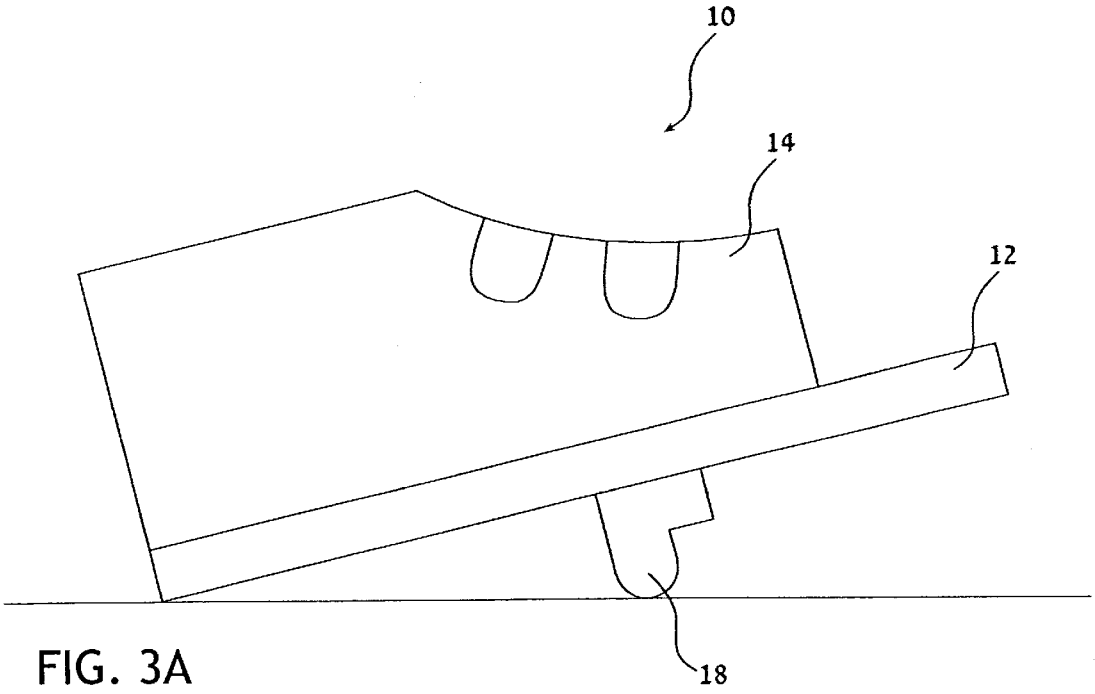
FIGS. 3A–3D are four schematic side views showing different applications of the shoe of FIG. 1.
Figure 3B:
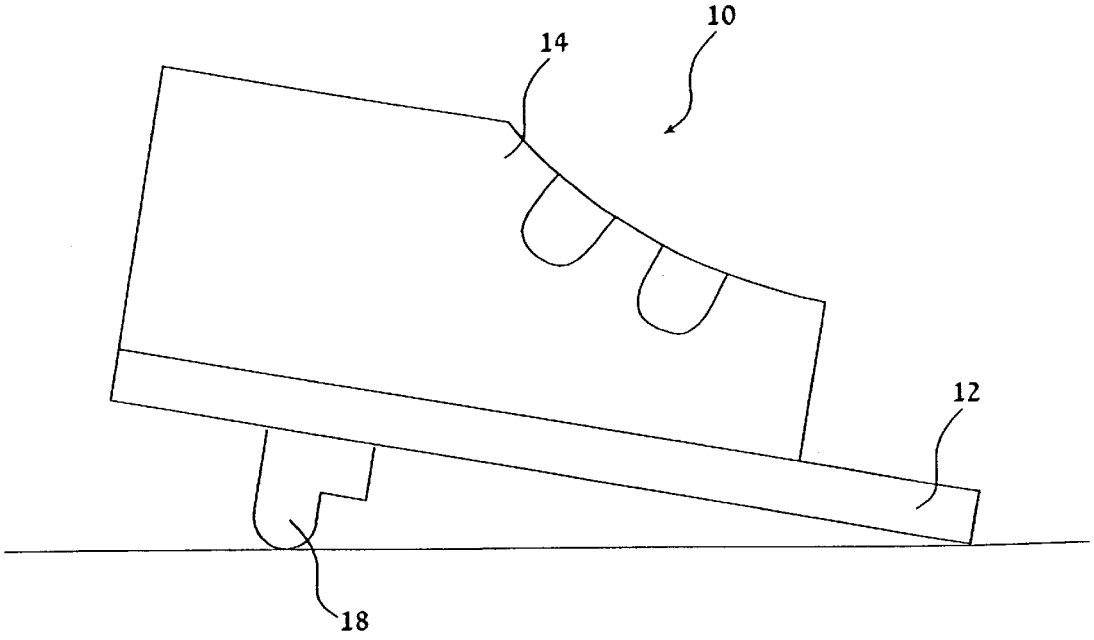

Turning now to FIGS. 3A–3D, these show four typical examples of configurations formed using therapeutic shoe 10 for pressure relief therapy. Referring first to FIG. 3A, this shows a configuration employing a single support block 18 located in a forward position, offering forefoot protection. FIG. 3B shows a second configuration, this time providing heel protection.

Figure 3C:
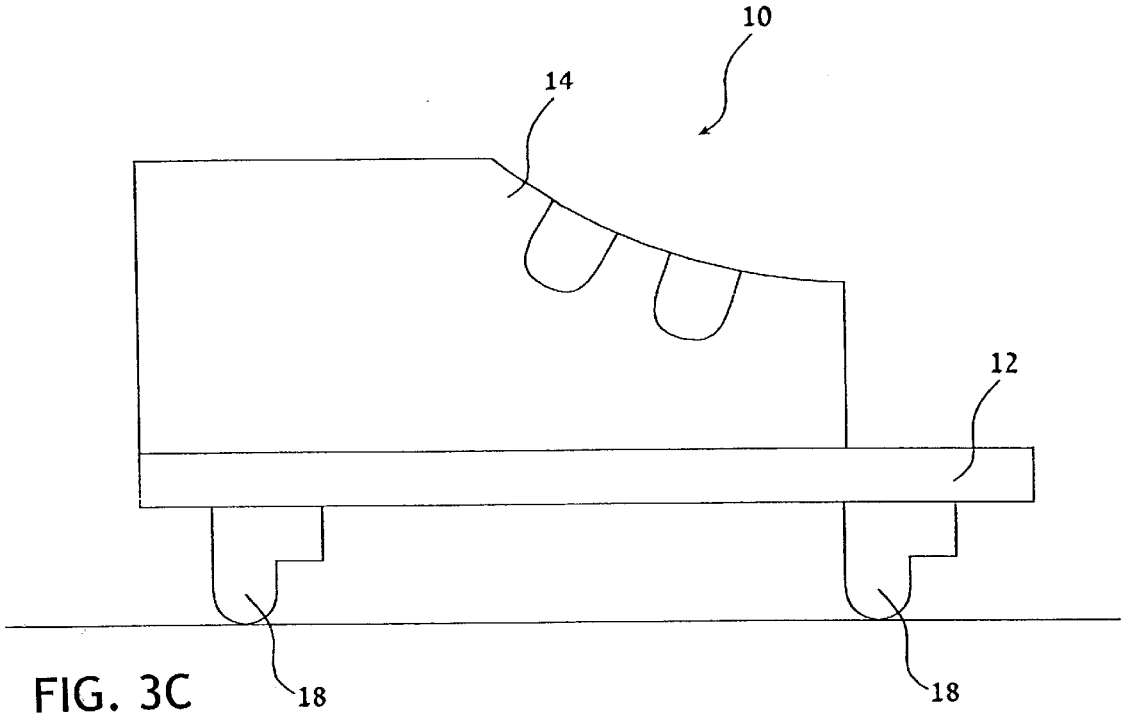
Figure 3D:
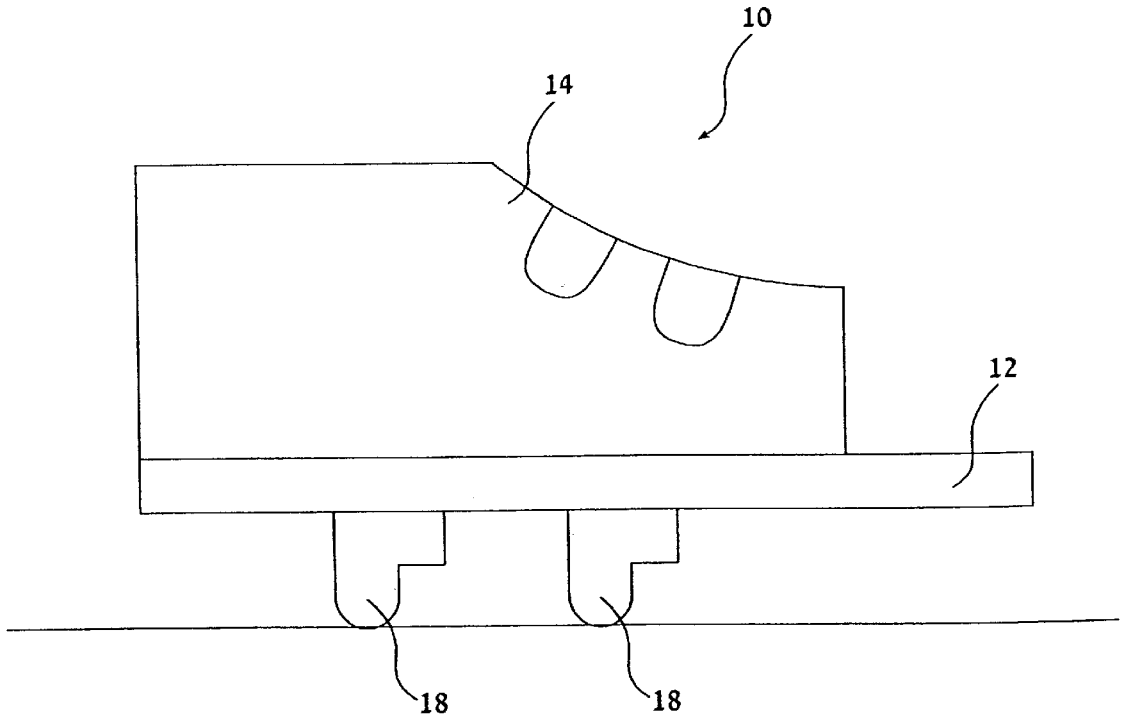

FIGS. 3C and 3D show further configurations in which two similar support blocks 18 are attached at different positions along track 16. In the configuration of FIG. 3C, the two supports are located at extreme positions to provide mid-foot protection. In that of 3D, they are brought inwards to offer simultaneous forefoot and heel protection.

Sole 12 and load-supporting body 22 may each be made from any suitable material. Typically, both are made from polymer materials of types conventionally used for shoe soles as are known in the art. Such materials inherently provide an appropriate degree of flexibility to distribute the weight of the user in a gradual manner over the region of sole 12 adjacent to load-supporting body 22.

Similarly, upper portion 14 may be made from any suitable material. Typically, it is formed from either leather or synthetic materials commonly used for shoe uppers. It should be noted that the type and style defined by the shape of upper portion 14 is not critical to the invention. Thus, in the particular preferred example illustrated here, upper portion 14 is formed with an open toe, thereby forming a sandal configuration. However, a closed-toe shoe may be preferred for some applications.

Figure 4:
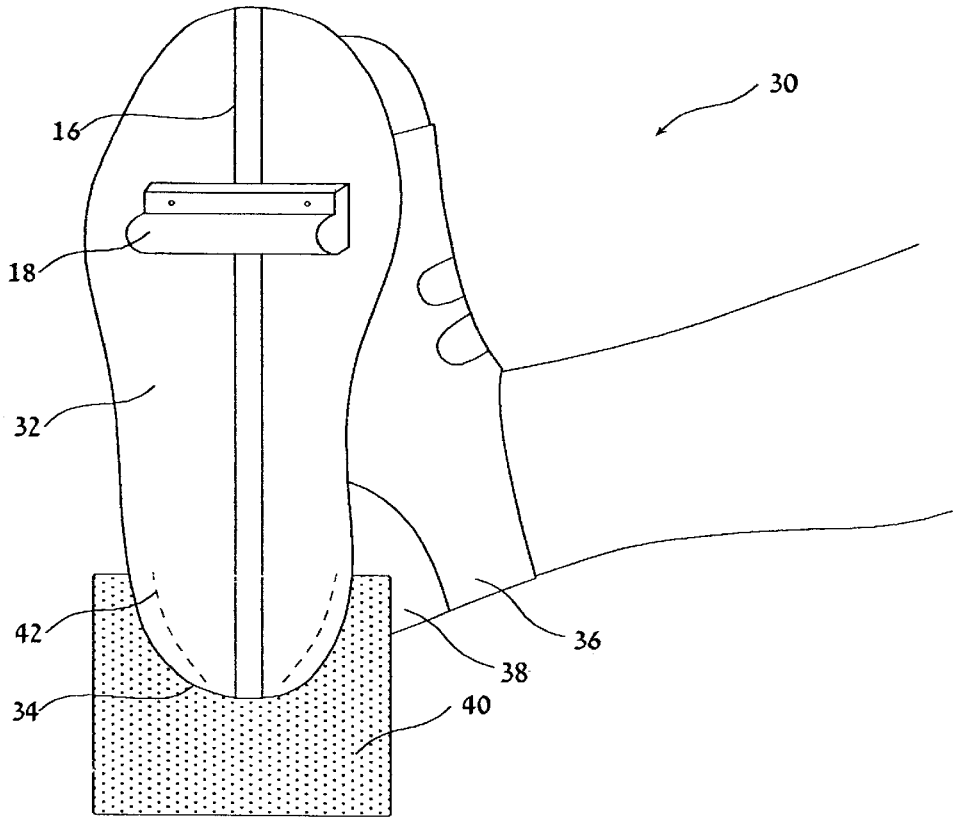
FIG. 4 is a schematic isometric view of a second embodiment of a therapeutic shoe, constructed and operative according to the teachings of the present invention, employing a pressure release bracket to protect the heel of a patient.
Figure 5:
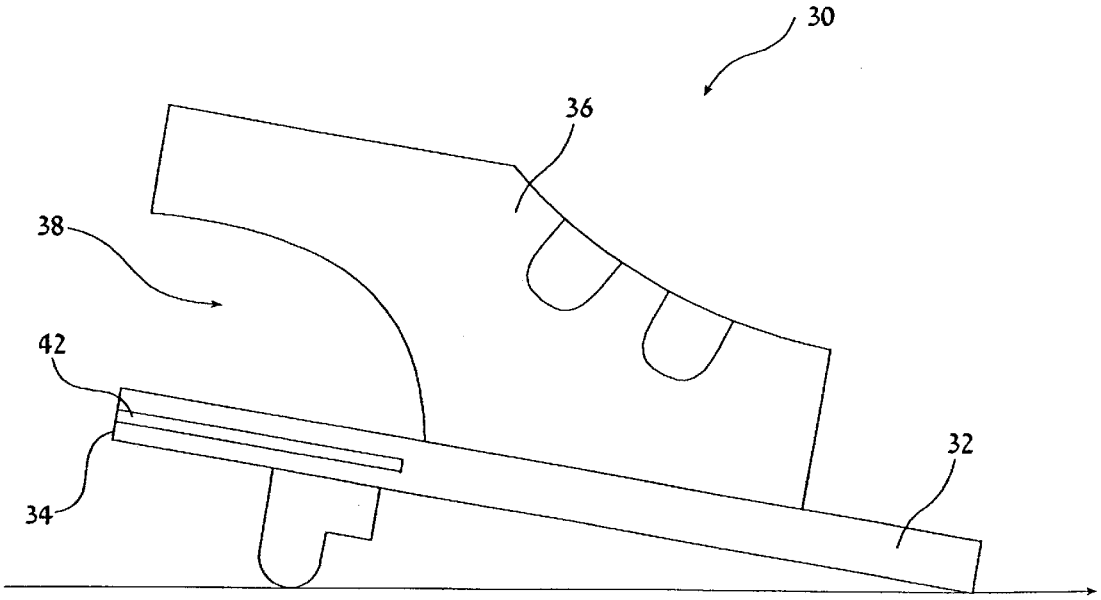
FIG. 5 is a schematic side view of the shoe of FIG. 4 with the pressure release bracket removed.

Turning now to FIGS. 4 and 5, as mentioned above, the present invention provides a second set of features which may be used alone or, in a preferred implementation as shown, together with the features described above, to avoid pressure on the heel of a foot while a wearer is lying in a supine position. Thus, there is shown a therapeutic shoe, generally designated 30, constructed and operative according to the teachings of the present invention. Generally speaking, therapeutic shoe 30 has a sole 32 providing an upper surface for supporting the foot of the wearer, and having a rear edge 34. In this case, an upper portion 36, associated with sole 32, is configured to retain the foot of the user in contact with sole 32 in a position such that the heel of the foot lies adjacent to rear edge 34. Upper portion 36 has at least one opening 38 adjacent to rear edge 34 configured to avoid contact with at least a part of the heel of the foot. A pressure release bracket 40 is configured to releasably engage sole 32 so that the sole is supported by pressure release bracket 40 with its rear edge 34 raised above the underlying surface.

It will be appreciated that the structure described ensures that the heel of the user does not experience any contact pressure with the adjacent surfaces. Specifically, over a wide range of "heel-down" foot positions, the weight of the foot is always transmitted through sole 32 to upper portion 36 which is configured to retain the foot without exerting any pressure on the heel. When the user has finished resting and the heel protection function is not currently required, bracket 40 is readily removed, as shown in FIG. 5, to allow shoe 30 to be used for walking.

It will be appreciated that the function of pressure release bracket 40 can be provided by a wide range of structures. In one particularly simple and preferred implementation, pressure release bracket 40 is implemented as a substantially flat sheet of metallic or polymer material. In this case, sole 32 preferably features a slot 42 adjacent to rear edge 34 within which pressure release bracket 40 is configured to sedge or clip into place.

As mentioned earlier, these features may optionally be used in combination with the above mentioned weight-shifting therapy features. Accordingly, the preferred embodiment shown here additionally features the track 16 and support block 18 described above.

It will be appreciated that the above descriptions are intended only to serve as examples, and that many other embodiments are possible within the spirit and the scope of the present invention.

What is claimed is:

1. A therapeutic shoe configured to facilitate shifting the weight exerted on the foot of a wearer in a frontward of rearward direction as required, the shoe comprising:

(a) a sole providing an upper surface for supporting the foot of the wearer and a lower surface, said sole having a longest dimension;

(b) an upper portion associated with said sole and configured to retain the foot of the user in contact with said sole;

(c) a recessed track formed in said lower surface of said sole and extending substantially parallel to said longest dimension along a major portion of said longest dimension; and (d) a support block having an engagement projection configured for engaging said recessed track and an elongated load-supporting body with a direction of elongation extending in a direction substantially perpendicular to said longest dimension, said support block being configured so as to be attachable to said lower surface at any one of a plurality of positions along substantially the entirety of said recessed track, said support being further configured to provide a non-rotating contact surface deployed so as to come into direct contact with a surface upon which the therapeutic shoe is placed.

2. The shoe of claim 1, wherein said recessed track includes at least one undercut ridge, said recessed track being open at at least one end, and wherein said engagement projection is configured to engage said undercut ridge.

3. The shoe of claim 1, wherein said recessed track is a substantially T-shaped track open at at least one end, and wherein said engagement projection is formed as a complementary T-shaped projection.

4. The shoe of claim 1, wherein said load-supporting body is formed with a rounded lower profile as viewed along its direction of extension.

5. The shoe of claim 1, further comprising at least two threaded fastening elements for attaching said support block to said lower surface.

6. The shoe of claim 1 further comprising an additional support block having an engagement projection configured for engaging said recessed track and an elongated load-supporting body with a direction of elongation extending in a direction substantially perpendicular to said longest dimension, said support block and said additional support block being attachable at different positions along said recessed track.

7. The shoe of claim 1 additionally configured to avoid pressure on the heel of a the foot while a wearer is lying in a supine position on an underlying surface, wherein said sole has a rear edge, said upper portion being configured to retain the foot in a position such that the heel of the foot lies adjacent to said rear edge, said upper portion having at least one opening adjacent to said rear edge so as to avoid contact with at least a part of the heel of the foot, the shoe further comprising a pressure release bracket configured to releasably engage said sole so that said sole is supported by said pressure release bracket with said rear edge raised above the underlying surface configured to support the foot of a supine wearer.

* * * * *